United States Patent [19]

Dahlstrom

[11] 4,068,564

[45] Jan. 17, 1978

[54] MACHINE FOR ROLLING NEWSPAPER INTO LOGS

[76] Inventor: Reuben O. Dahlstrom, 435 Second Ave. NW., Milaca, Minn. 56353

[21] Appl. No.: 695,160

[22] Filed: June 11, 1976

[51] Int. Cl.[2] ..... B31C 1/00

[52] U.S. Cl. ..... 93/1 C; 93/81 R; 242/67.1 R

[58] Field of Search ..... 93/1 C, 81 R; 242/67.1 R

[56] References Cited

U.S. PATENT DOCUMENTS

| | | | |
|---|---|---|---|
| 456,615 | 7/1891 | Clark | 93/81 R |
| 968,855 | 8/1910 | Kellner | 93/81 R |
| 3,936,007 | 2/1976 | Butz | 93/1 C |
| 3,964,373 | 6/1976 | Christen, Jr. et al. | 93/1 C |

*Primary Examiner*—James F. Coan
*Attorney, Agent, or Firm*—Clarence A. O'Brien; Harvey B. Jacobson

[57] ABSTRACT

A paper rolling machine designed to roll newspaper and scrap paper into burnable logs, which machine has end plates and a central winding roller, tapered and grooved, with a crank arm at its larger end and which roller is removably inserted between the end plates, ancillary spring urged rollers floating in oblong slats in the end plates, which apply constant pressure to the central winding roller on three sides thus accommodating different thicknesses of logs, the machine being capable of being stopped at any stage of operation, and the rolling operation resumed without loss of time, motion and material.

9 Claims, 4 Drawing Figures

MACHINE FOR ROLLING NEWSPAPER INTO LOGS

BACKGROUND OF THE INVENTION

Field of the Invention

Rolling logs from newspapers has been an accepted method of disposing of the newspaper in the most conservative sense and utilizing it as a cheap fuel source at the same time.

Some paper rollers on the market necessitate the use of wetting agents, which is a messy business. Others rely on mechanical pressure between the main roller and the bed, causing a dragging effect which is difficult to maneuver.

Other paper rolling devices on the market consist of a single winding roller, without mechanical pressure, and requiring constant hand manipulation of the paper as the roll is being formed. Thus, as the operator (necessarily) releases the accumulating roll to feed in more paper, he temporarily loses control and the forming roll tends to unravel. Other machines have difficulty in removing the central winding roller after the completion of rolling the log. They also require fastening to a firm base such as a table or bench. These major disadvantages are eliminated in the instant machine, which is portable.

SUMMARY OF THE INVENTION

It is the object of the present apparatus to conserve fuel, to salvage waste paper, to compact it in such a way that it can be used to replace fire wood. The device has been designed so that its operation may be stopped at any stage and resumed at another time without loss of time, material or energy.

It is simple to manufacture, inexpensive and practical. Any scrap papers, such as junk mailings, with which people are daily inundated, and magazines, can be put to use because the device is capable of incorporating into its product, odd size papers within the standard newspaper sheets.

The device is susceptible to being made in an ornamental casing so as to serve as an attractive fireplace accessory.

The device may be considered a compactor of paper per se wherein the end product is not a fireplace log or fuel, but a way of neatly disposing of bulky and messy scrap paper materials.

These, together with other objects and advantages which will become subsequently apparent, reside in the details of constructions and operation as more fully hereinafter described and claimed, reference being had to the accompanying drawings forming a part hereof, wherein like numerals refer to like parts throughout.

DETAILED DESCRIPTION OF THE DEVICE

Figure 1:
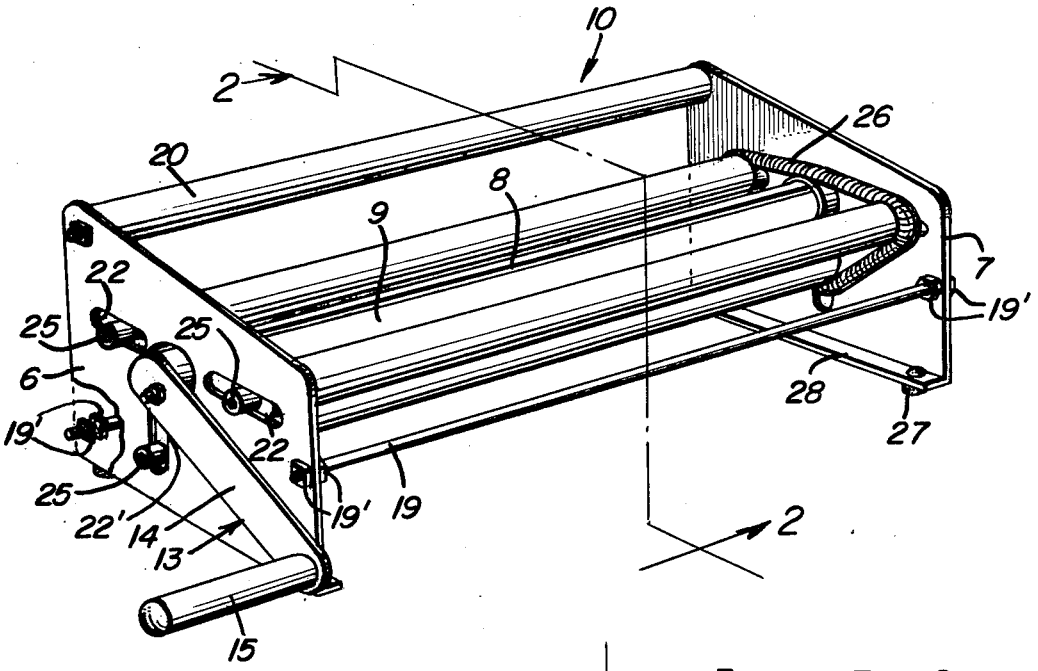
FIG. 1 is a perspective view of the paper roller.

Referring now to the drawings in more detail, wherein like reference characters indicate like parts throughout the several figures, 10 indicates generally a paper rolling device constructed in accordance with the present invention.

Figure 3:
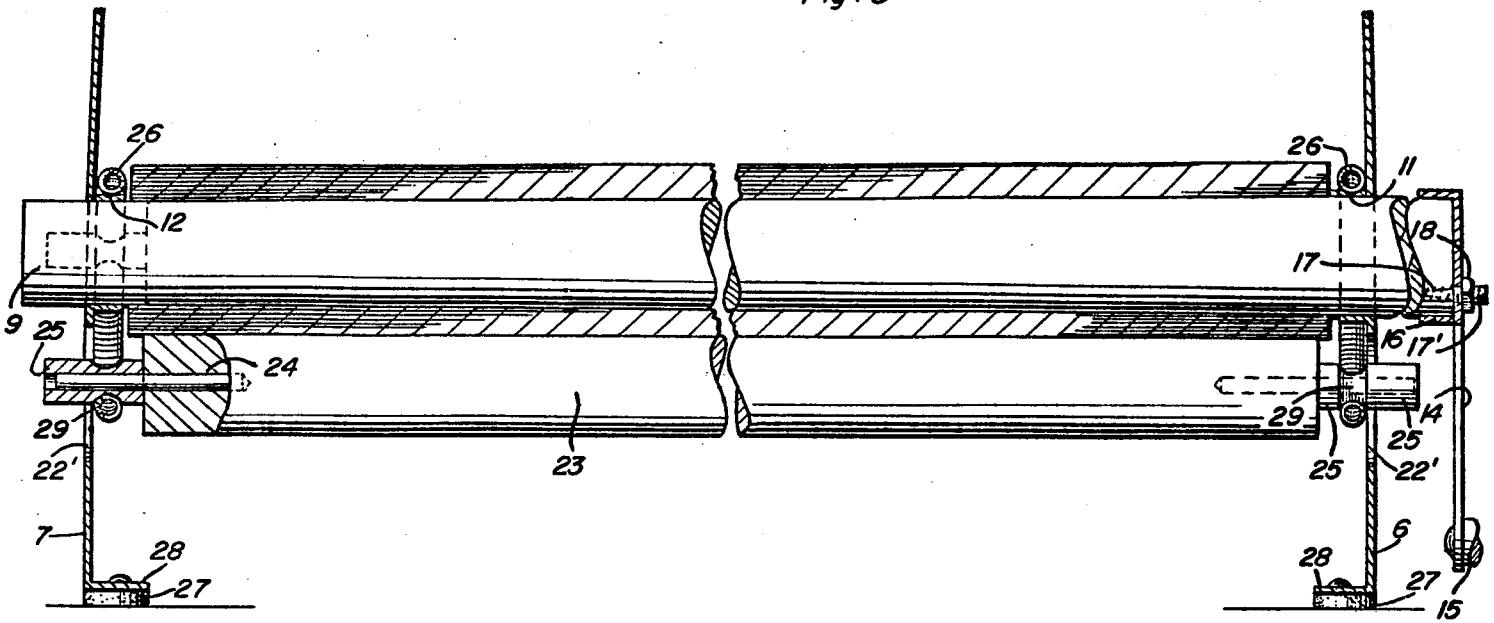
FIG. 3 is a front sectional view taken along line 3—3 of FIG. 2.
Figure 4:
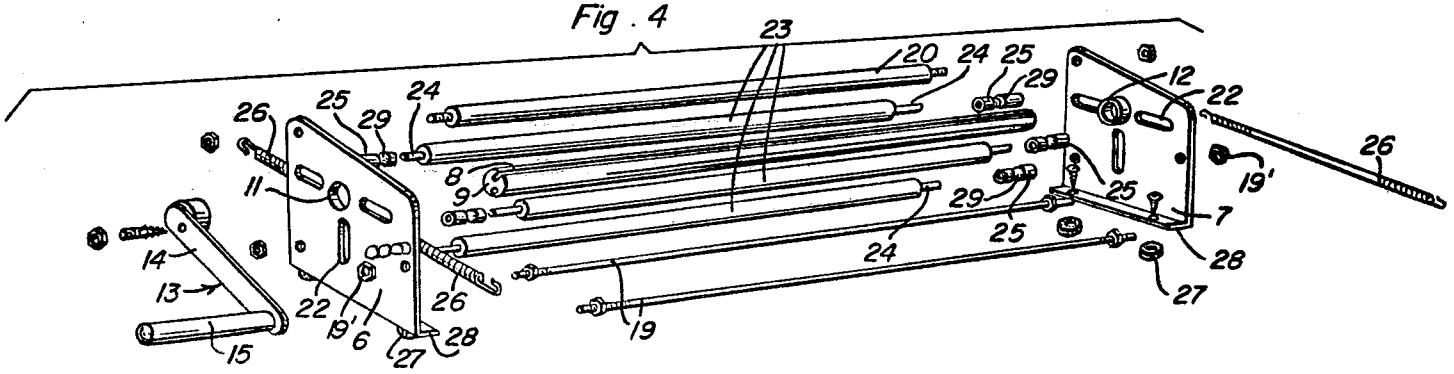
FIG. 4 is an exploded view of the component parts shown assembled in FIG. 1.

The paper rolling device has end plates 6 and 7 between which is contained the mechanism of the device. A removable central winding roller 9 tapered so that one end is one-fourth inch larger in diameter than the other, and having a groove 8 along its longitudinal extent, is removably journaled in extruded openings 11, 12 in the end plates 6, 7, respectively. The smaller end of roller 9 is journaled through opening 12 of the end plate 7, and the larger end of the tapered winding roller 9 is journaled through opening 11 of plate 6. The opening 11 is one-fourth inch greater in diameter than opening 12 to accommodate the taper of roller 9. The winding roller is made of wood which is solid, has a higher coefficient of friction than metal or plastic, and is compatible with paper and will grab it effectively. A crank 13 comprising an arm 14 and a crank handle 15 extending at right angles outwardly of the arm 14 is attached to the central winding roller 9. A cup 16 is secured as by welding to the base end of the arm 14 and is pressed upon the larger end of the roller 9. A bolt 17 is threaded into the roller 9 and includes a machine screw threaded outer end 17' which projects through the cup and arm 14 and has a threaded nut 18 threaded thereon to tighten and secure the arm 14 on the roller 9, see FIG. 3.

Figure 2:
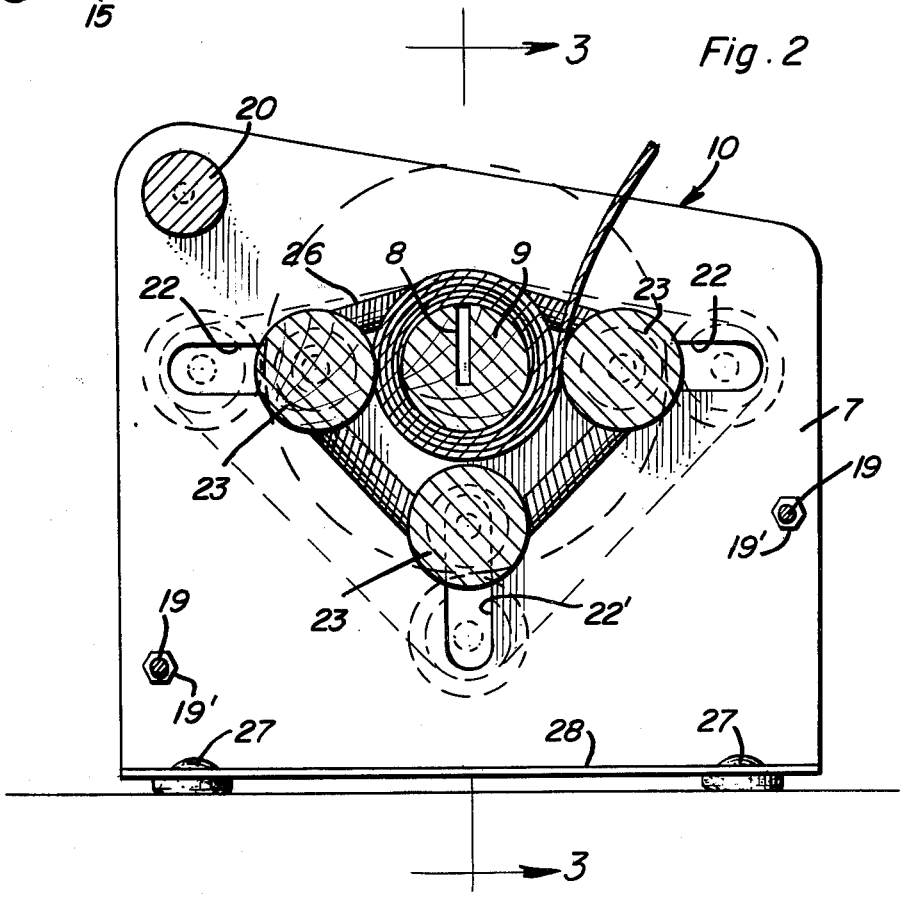
FIG. 2 is a sectional view taken on line 2—2 of FIG. 1.

End plates 6 and 7 are held together rigidly by two support rods 19 which have threaded ends. Each rod 19 has its threaded ends secured through the plates by a pair of threaded nuts 19' on each end, one on the outside of the corresponding end plate and the other on the inside of that end plate. The rods 19 are secured through apertures in the end plate, one rod at the rear bottom edge of end plates 6 and 7 and the other at midway of the forward vertical edge of the end plates. Carrying handle 20 is similarly secured between the rear upper portions of the end plates 6 and 7. The end plates 6 and 7 include upper edges inclined downwardly from rear to front, as seen in FIGS. 1 and 2, thus making feeding of the paper to the roller easier. The rods 19 and carrying handle 20 serve to rigidly connect the end plates 6 and 7. The end plates 6 and 7 have right angled lower base flange portions 28 which may be bolted to a base 5 or set upon a base surface, such as a table. Rubber bumpers 27 are attached to the right angled base flange portions of the end plates are prevent slippage on and marring of a table upon which the paper rolling device is placed.

Oblong horizontal slots 22 are formed in the end plates 6 and 7 to the front and rear of the extruded openings 11 and 12 and vertical oblong slots 22' are formed below the openings 11 and 12. The three floating wood rollers 23 have steel pins 24 secured in and projecting out of the opposite ends thereof. Each outer pin end has a sleeve 25 journaled thereon slidably and rotatably received in the corresponding slot and each sleeve is circumferentially grooved as at 29 inwardly of the corresponding end plate. An endless expansion spring 26 is trained about and seated in the grooved sleeve portions to spring bias the rollers 23 toward the winding roller 9 and help to make a firm log. For the sake of appearance, the bearings 25 are placed in the slots so that the grooved portions 29 are disposed inwardly on the end plates 6 and 7, and spring 26 also serves to retain the sleeves 25 against axial displacement outwardly through the slots 22 and 22'.

Operation of the Device

A section of newspaper is folded about 1 inch deep along the short edge parallel to the central crease of the newspaper and the folded edge is placed within the groove 8 of the winding roller 9 from the front of the machine and the crank handle 13 is then turned. When a 6 inch to 8 inch end portion of paper remains to be wound after the initial winding, the next sheet of paper is placed between the remaining unwound portion of the winding roller 9. Similar operations are repeated until a log of rolled paper of approximately 4 inches to 5 inches in diameter is formed. The paper of the log will not unroll no matter what stage of winding it is left in, so that odd sized pieces of paper may be placed in the roll, but the roll should be ended with a full size sheet of paper.

When the roll has reached its desired diameter, the crank is turned until the end papers are uppermost. Then, the log is tied with cord, one cord 4 inches from each end. The log is removed from the device by placing the crank handle 15 up, holding the log down with one hand and jiggling the crank forward and back with the other hand while applying axial pressure on the crank 13 to remove the winding roller from the log. The winding roller 9 will release from the paper readily because of the taper of the roller 9.

The foregoing is considered as illustrative only of the principles of the invention. Further, since numerous modifications and changes will readily occur to those skilled in the art, it is not desired to limit the invention to the exact construction and operaion shown and described, and accordingly all suitable modifications and equivalents may be resorted to, falling within the scope of the invention.

What is claimed as new is as follows:

1. A paper roller having spaced relatively braced end supports, a winding roller removably journaled between the end supports, a plurality of spring urged floating rollers journaled between the end supports and opposing the winding roller from remote sides to apply continual pressure thereto, rotary torque input means drivingly connected to the winding roller, said end supports defining elongated guides disposed on remote sides of said winding roller and extending generally radially of the axis of rotation of the latter, bearings mounted in said guides for shifting therealong, the opposite ends of said floating rollers being journaled from said bearings, said bearings at each end support including aligned recessed portions facing outwardly from said winding roller, and an endless spring member trained about each set of corresponding recessed portions yieldingly biasing said bearings, and thus said floating rollers, inwardly along said guides toward said winding roller.

2. A paper roller as in claim 1 including bracing rods extend between the spaced end supports to rigidify the structure.

3. A paper roller as in claim 2, wherein the end supports have a rearwardly inclined upper surface to encourage feeding the paper from the front.

4. A paper roller as in claim 3 wherein a carrying handle is permanently attached to and extends between the uppermost rearward portions of the end supports, permitting it to be used to hold the device firmly on a solid base or table with one hand while turning the winding roller with the other hand.

5. A paper roller as in claim 1 wherein said rotary torque input means comprises a crank arm with a cup-shaped member secured at one end to receive the larger end of the winding roller, and which is bolted thereto, and a crank handle at the other end of the crank arm extending at right angles to the arm and in the direction opposite the cup-shaped member.

6. A paper roller as in claim 1 wherein said winding roller is tapered toward one end thereof, the opening in one end support being larger in diameter than the other opening to accommodate the taper of the winding roller.

7. A paper roller as in claim 3 wherein rubber feet are attached to the lower portions of said end supports for supporting said paper roller from a horizontal support surface.

8. A paper roller having spaced relatively braced end supports, a winding roller removably journaled between the end supports, a plurality of spring urged floating rollers journaled between the end supports and opposing the winding roller from remote sides to apply continual pressure thereto, rotary torque input means drivingly connected to the winding roller, said end supports defining aligned openings through which the opposite ends of said winding roller are received, said supports each further defining front and rear horizontal slots extending forwardly and rearwardly, respectively, of the central opening, and vertical slots disposed beneath the central opening, for the reception of the floating rollers, said floating rollers including bearings on their opposite ends slidably mounted in the corresponding slots, the bearings at each end support having a chamfered portion inwardly of the end support, an endless spring member trained about each set of corresponding chambered portions and urging the floating rollers into constant contact with the winding roller.

9. The combination of claim 8 wherein said winding roller is tapered toward one end thereof.

* * * * *